United States Patent [19]

Sugita

[11] Patent Number: 4,730,717

[45] Date of Patent: Mar. 15, 1988

[54] CURVED ESCALATOR

[75] Inventor: Kazuhiko Sugita, Inazawa, Japan

[73] Assignee: Mitsubishi Denki Kabushiki Kaisha, Tokyo, Japan

[21] Appl. No.: 17,034

[22] Filed: Feb. 18, 1987

Related U.S. Application Data

[63] Continuation of Ser. No. 647,650, Sep. 6, 1984, abandoned.

[30] Foreign Application Priority Data

Sep. 12, 1983 [JP] Japan ..... 58-167828
Sep. 12, 1983 [JP] Japan ..... 58-167831

[51] Int. Cl.[4] ..... B66B 21/02

[52] U.S. Cl. ..... 198/328; 198/332; 198/778

[58] Field of Search ..... 198/326, 328, 332, 778, 198/831, 838, 845, 852

[56] References Cited

U.S. PATENT DOCUMENTS

| | | | |
|---|---|---|---|
| 710,934 | 10/1902 | Aston | 198/845 |
| 727,720 | 5/1903 | Venn | 198/328 |
| 782,009 | 2/1905 | Dodge | 198/778 |
| 2,600,174 | 6/1952 | Sheehan | 198/852 |
| 2,641,351 | 6/1953 | Riley | 198/328 |
| 3,489,260 | 1/1970 | Hara et al. | 198/328 |
| 4,399,909 | 8/1983 | Gorelik | 198/852 |
| 4,681,206 | 7/1987 | Sugita | 198/328 |

FOREIGN PATENT DOCUMENTS

| | | | |
|---|---|---|---|
| 551716 | 6/1932 | Fed. Rep. of Germany | 198/326 |
| 558325 | 8/1932 | Fed. Rep. of Germany . | |
| 601565 | 8/1934 | Fed. Rep. of Germany | 198/328 |
| 628965 | 4/1936 | Fed. Rep. of Germany | 198/328 |
| 1406832 | 10/1968 | Fed. Rep. of Germany | 198/852 |
| 2252268 | 6/1975 | France . | |
| 48-25559 | 7/1973 | Japan | 198/328 |
| 203187 | 9/1923 | United Kingdom | 198/328 |
| 354169 | 9/1931 | United Kingdom | 198/326 |
| 2027658 | 2/1980 | United Kingdom | 198/852 |
| 880939 | 11/1981 | U.S.S.R. | 198/326 |

*Primary Examiner*—Joseph E. Valenza
*Assistant Examiner*—Jonathan D. Holmes
*Attorney, Agent, or Firm*—Leydig, Voit & Mayer

[57] ABSTRACT

A curved escalator comprising a plurality of segment steps having step axles connected to an inner and an outer endless loop of step chains so that the steps circulate along the endless loops, and inner and outer sprocket wheels having different diameters for turning around the step axles along a conical surface in turn-around portions of the loop in engagement with the inner and outer endless chain loops, the bottom surfaces of the teeth being engageable with the step axles of the inner and outer sprocket wheels having sloped surfaces that are parallel to the axis of the step axles in the turn-around portion, and the teeth having the same pitch circle. Since the bottom surfaces of the teeth engaging the step axles have sloped surfaces that are parallel to the axis of the step axles in the turn-around portion, and since the pitch circles of the teeth are the same, the driving force is transmitted to the step axles and the step chain, and the steps are smoothly turned around to provide a better ride.

2 Claims, 11 Drawing Figures

CURVED ESCALATOR

This application is a continuation of application Ser. No. 647,650, filed Sept. 6, 1984, now abandoned.

BACKGROUND OF THE INVENTION

This invention relates to curved escalators.

As disclosed in Japanese Patent Publication No. 48-25559, a curved escalator which has a circular shape in plan view is provided on a framework with an endless stairway path including an inclined load-bearing run on the upper side of the loop path, a return run on the lower side of the loop, and turn-around portions at the opposite ends of the runs, and a plurality of segment-shaped steps are arranged in the stairway path with their step axles connected to an inner and an outer step chain loop defining the stairway path. In the curved escalator, an inner and an outer sprocket wheel having different diameter are mounted in the upper and the lower turn-around portions to engage and guide the inner and the outer step chain loops, respectively. The inner and the outer sprocket wheels in either the upper or the lower turn-around portion are driven by a drive mechanism for turning around the inner step chain at a radius smaller than that of the outer step chain, whereby the step axles connected to the inner and the outer step chain loops and hence treads of the steps are moved along a conical surface in the turn-around portions.

However, with the conventional curved escalator as described above, since the bottom surfaces between the teeth of the sprocket wheel are formed with no slope with respect to the axis of the sprocket wheel, since the step axles engage selected teeth of the sprocket wheel at a predetermined pitch, and the step axles turn around along a conical surface with their axes inclined with respect to the axis of the sprocket wheel, it has been difficult to cause the steps to smoothly and reliably turn around and a problem arises that the step chain oscillates, providing an uncomfortable ride.

SUMMARY OF THE INVENTION

Accordingly, an object of the present invention is to provide a curved escalator in which a driving force is transmitted to the step axles and the step chain, and the steps are smoothly turned around to provide a better ride.

Another object of the present invention is to provide a curved escalator in which the steps are stably and smoothly moved along the load bearing run of the stairway path and in which the abrasion of the guide rollers is minimized.

With the above objects in view, the curved escalator of the present invention comprises a plurality of segment steps having step axles connected to an inner and an outer endless loop of step chains so that the steps circulate along the endless loops, and inner and outer sprocket wheels having different diameters for turning around the step axles along a conical surface in turn-around portions of the loop which are in engagement with the inner and outer endless chain loops, with bottom surfaces of the teeth engageable with the step axles of the inner and outer sprocket wheels having bevelled surfaces that slope downwards so as to be parallel to the axis of the step axles in the turn-around portion, and with the teeth having the same pitch circle.

Since the bottom surfaces lying between the teeth engaging the step axles have surfaces sloped so as to be parallel to the axis of the step axles in the turn-around portion, and since the pitch circles of the teeth are the same, the driving force is transmitted to the step axles and the step chain, and the steps are smoothly turned around to provide a better ride.

Also, since each of the step axles comprises a roller mount rotatably mounted on ends of the step axle, a guide roller rotatably mounted on the roller mount with the guide roller being rotatable about an axis perpendicular to the step axle, and drive rollers mounted on both sides of the guide roller with the drive rollers being rotatable about an axis parallel to the step axle, the steps are stably and smoothly moved along the load bearing run of the stairway path and the abrasion of the guide rollers is minimized.

BRIEF DESCRIPTION OF THE DRAWINGS

The invention will become more readily apparent from the following detailed description of the the preferred embodiments taken in conjunction with the accompanying drawings, in which.

DESCRIPTION OF THE PREFERRED EMBODIMENTS

Figure 1:
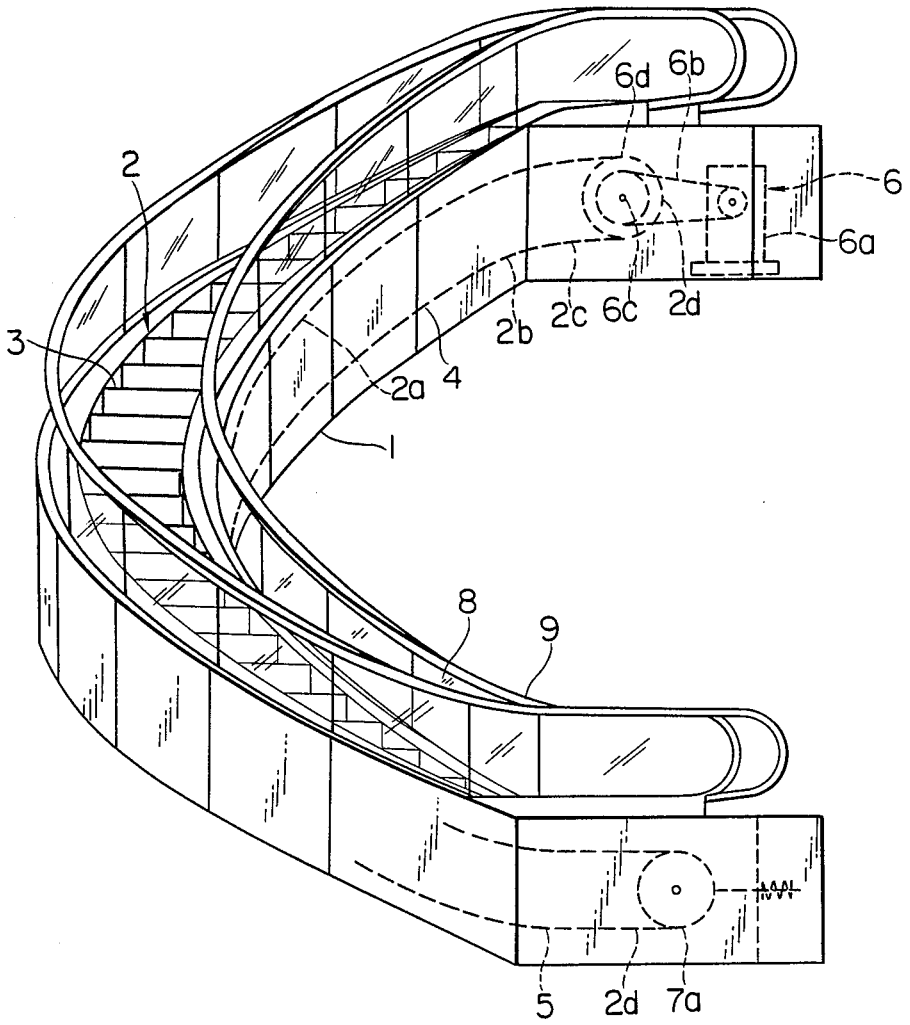
FIG. 1 is a schematic front view of the curved escalator of the present invention.
Figure 2:
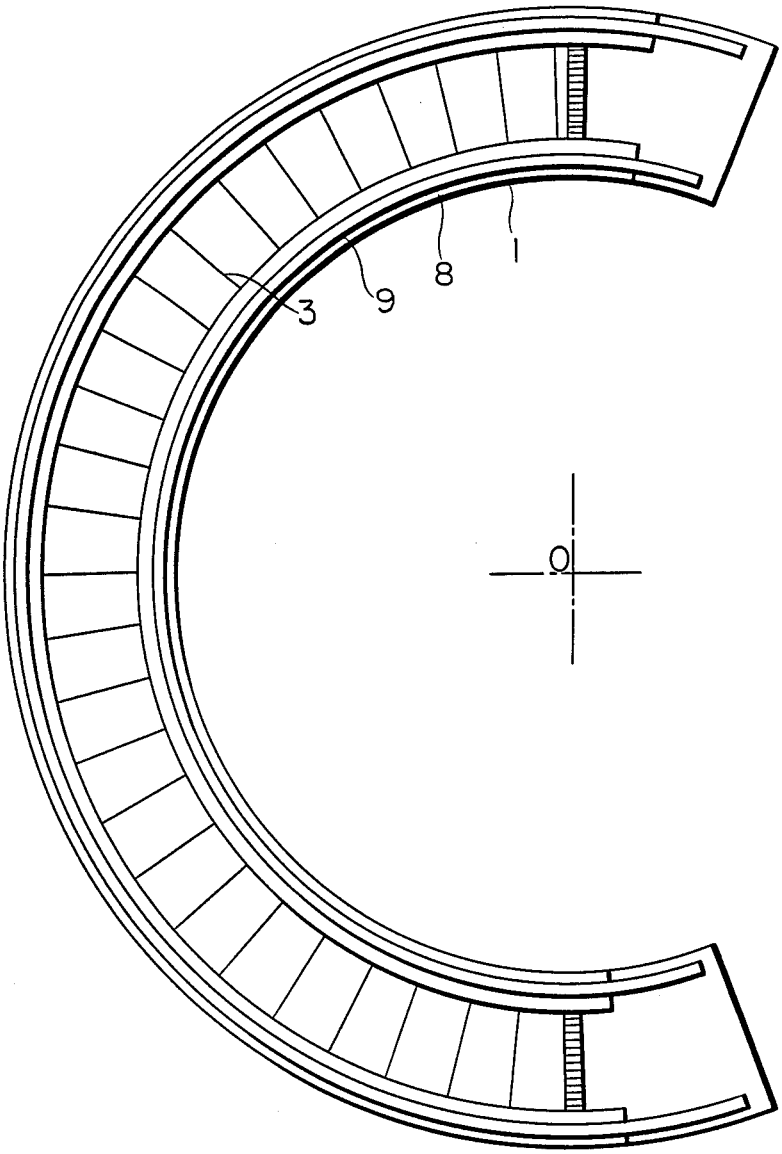
FIG. 2 is a plan view of the curved escalator shown in FIG. 1.

In FIGS. 1 and 2, a curved escalator of the present invention comprises a main frame 1 having defined therein a stairway path 2 that has a constant radius of curvature or is circular in plan throughout its entire length. The stairway path 2 includes a central, inclined section **2*a*, transient sections 2*b*, upper and lower horizontal landing sections 2*c*, and upper and lower turn-around portions 2*d*. The upper portion of the central inclined section 2*a* is a load-bearing run of an endless loop and the lower portion of the section 2*b* is a return run of the endless loop. A series of segment steps 3 each having a step axle 3*a* are connected to each other and disposed along the stairway path 2. The step axles 3*a* of the segment steps 3 are connected to inner and outer step chains 4 and 5, respectively, which are driven by a drive unit 6 mounted on the upper end of the main frame 1. The drive unit 6 transmits a driving force from a drive motor 6*a* through a chain 6*b* to a sprocket wheel shaft 6*c*. The shaft 6*c* is disposed at the center of the upper turn-around portion 2*d* of the stairway path 2** and has securely mounted thereon inner and outer sprocket wheels 6*d* and 6*e* which engage with the inner and outer step chains 4 and 5, respectively. In the lower landing section 2*c*, an outer tension sprocket wheel 7*a* engaging the outer chain 5 is mounted to define the lower turn-around portion 2*d* of the stairway path 2. Although not illustrated, an inner tension sprocket wheel is mounted concentrically with respect to the outer sprocket wheel 7*a* within the lower landing section 2*c*. The curved escalator also comprises a balustrade 8 including a handrail 9 thereon on each side of the stairway path as is well known in the art.

Figure 3:
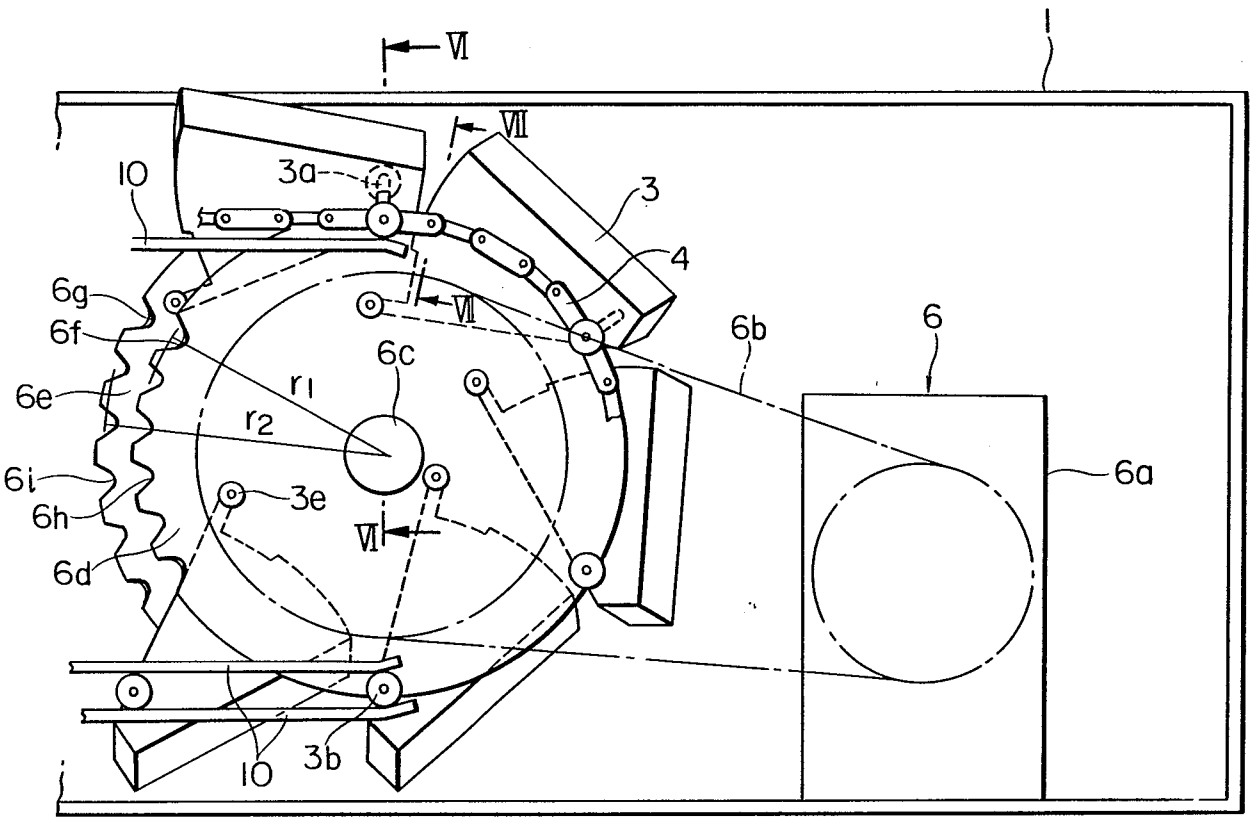
FIG. 3 is a side view of the upper turn-around portion of the stairway path of the embodiment of the present invention.

FIG. 3 shows an upper turn-around portion of the stairway path 2, in which the inner sprocket wheel 6*d* has a smaller diameter than the outer sprocket wheel 6*e*. These inner and outer sprocket wheels 6*d* and 6*e* are engaged by the step axles 3*a* at a predetermined pitch. It is seen that some of the tooth pairs, i.e., the tooth pairs between which the step axles 3*a* are received, are formed on the same pitch circles $r_1$ and $r_2$ as other teeth 6*h* and 6*i* and have bottom surfaces 6*f* and 6*g* inclined with respect to the sprocket shaft 6*c* and parallel to the step axles 3*a* in the turn-around portion. Other tooth pairs 6*h* and 6*i* have bottom surfaces have no slope with respect to the sprocket shaft 6*c*. Although not illustrated, the inner and outer tension sprockets in the lower turn-around portion 2*d* have a tooth arrangement similar to that of the upper inner and outer sprocket wheels 6*d* and 6*e*.

Figure 4:
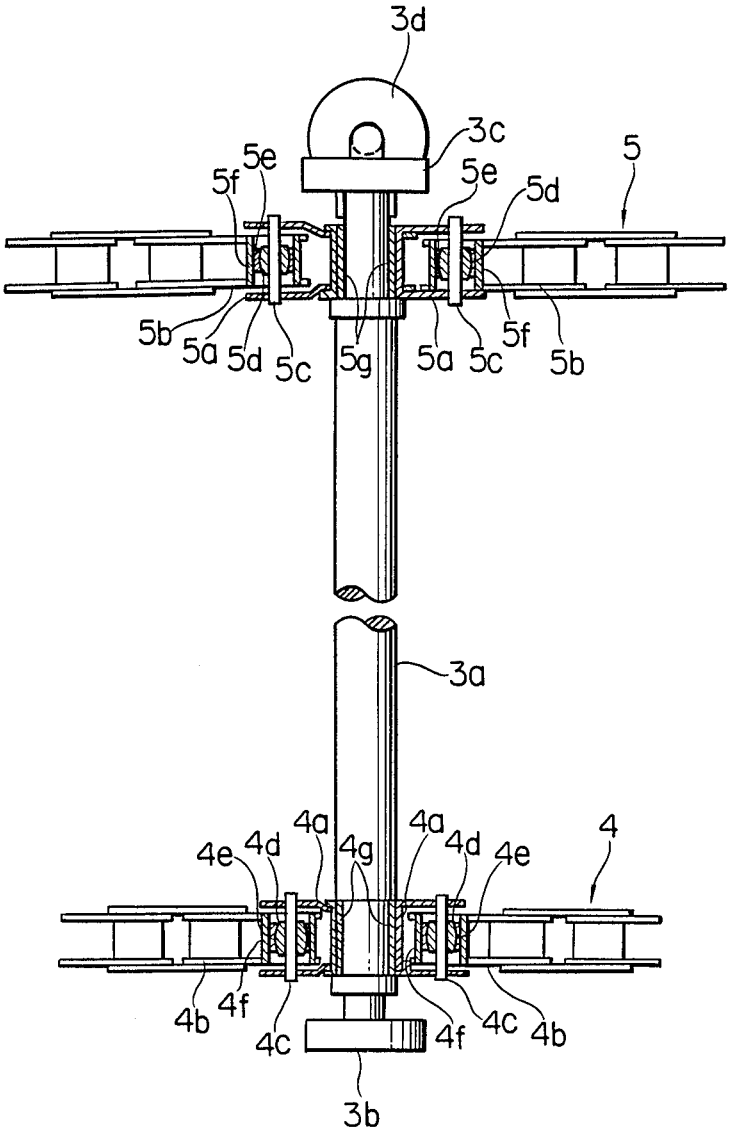
FIG. 4 is a partial sectional view showing how the step axle and the step chain are connected.

FIG. 4 illustrates the step axle 3*a* connected to the inner and outer step chains 4 and 5. The inner and outer step chains 4 and 5 have joint pieces engaged with end parts of each step axle 3*a* so that the step chains are allowed to deflect three-dimensionally, i.e., in three directions perpendicular to each other only at the connections to the step axles 3*a*. The joint pieces include links 4*a* and 5*a* placed over cylindrical rollers 4*g* and 5*g* and links 4*b* and 5*b* adjacent to the links 4*a* and 5*a*. The joint pieces further include rollers 4*d* and 5*d* having a spherical outer surface and carried by pins 4*c* and 5*c* mounted on the links 4*a* and 5*a*, and the rollers 4*d* and 5*d* are rotatably journaled by bearings 4*e* and 5*e* which have a concave spherical surface complementary to the outer surface of the spherical rollers 4*d* and 5*d*. The bearings 4*e* and 5*e* are supported within hollow cylindrical rollers 4*f* and 5*f* mounted at one end of adjacent link members 4*b* and 5*b* such that one end part of each joint piece containing the spherical roller 4*d* or 5*d* is connected to the end part having the cylindrical roller 4*f* or 5*f* of an adjacent link member 4*b* or 5*b*.

Figure 5:
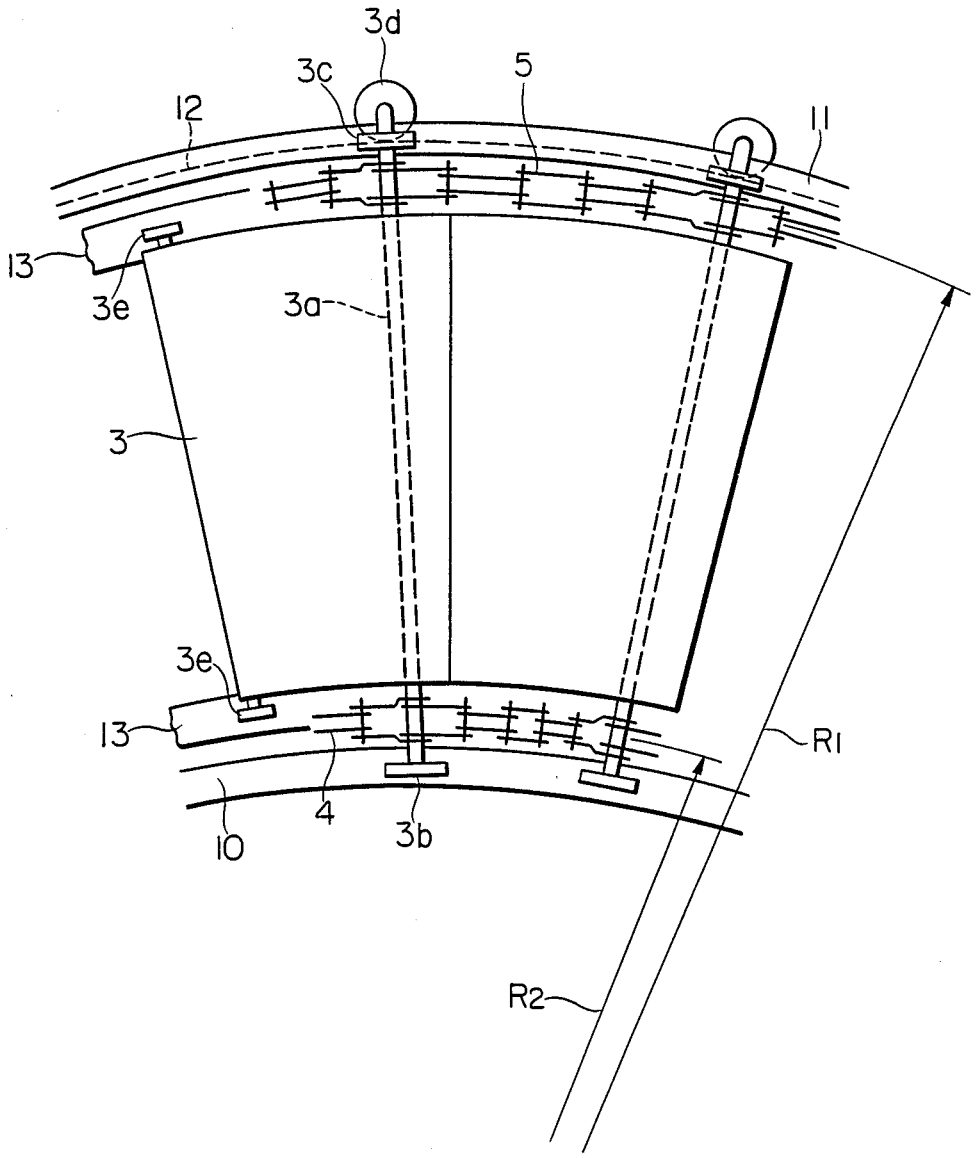
FIG. 5 is a partial plan view illustrating the steps and the step chains.

On the opposite ends of the step axle 3*a* of the step 3 are rotatably mounted drive rollers 3*b* and 3*c* rotatable about the axis of the axle 3*a*, and a guide roller 3*d* rotatable about the axis perpendicular to the step axle 3*a* is mounted on the outer end of the step axle 3*a*. As shown in FIG. 5, trailing rollers 3*e* are rotatably mounted on both sides of the step 3. The above-mentioned rollers 3*b*, 3*c*, 3*d* and 3*e* are guided and supported by various guide rails 10, 11, 12 and 13, respectively.

With the above-described arrangement, the drive unit 6 drives the sprocket wheels 6*d* and 6*e* to move the inner and outer step chains 4 and 5, thereby causing the circulating movement along the stairway path 2 of the steps 3 though the step axles 3*a*.

Figure 6:
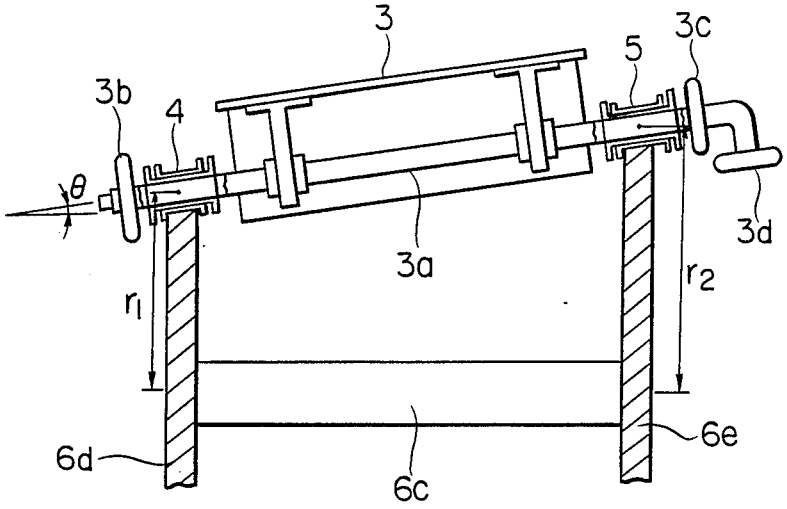
FIGS. 6 and 7 are sectional views taken along the lines VI—VI and VII—VII of FIG. 3.

As shown in FIG. 3, the steps 3 are turned around in a vertical plane within the turn-around portions 2*d* of the stairway path 2. Since radii of the pitch circles of the inner and outer step chains 4 and 5 wound around the smaller inner sprocket wheel 6*d* and the larger sprocket wheel 6*e* are $r_1$ and $r_2$, respectively, radii of curvature $R_1$ and $R_2$ of the inner and outer step chains 4 and 5 are expressed by $r_1:r_2=R_1:R_2$. Since the pitch circle radii $r_1$ and $r_2$ of the inner and outer sprocket wheels 6*d* and 6*e* are different, the step axles 3*a* are inclined at an angle $\theta$ and turn around along a conical surface as shown in FIG. 6. In the illustrated embodiment, the recessed portion between the teeth 6*f* and 6*g* within which the step axle 3*a* are received has inclined surfaces 6*f* and 6*g*, and the links 4*a* and 5*a* engaging the step axle 3*a* of the inner and outer step chains 4 and 5 and the links 4*b* and 5*b* adjacent to the first-mentioned links 4*a* and 5*a* are deflectable in three directions perpendicular to each other, so that the rollers 4*g* and 5*g* rotatably mounted on the step axle 3*a* and the links 4*a* and 5*a* of the step chains 4 and 5 as well as the step axle 3*a* are inclined by the angle $\theta$ with respect to the sprocket wheel shaft 6*c* as shown in FIG. 6. Therefore, a desirable good contact is provided between the teeth 6*f* and 6*g* of the sprocket wheels 6*d* and 6*e* and the rollers 4*g* and 5*g*, as well as between the rollers and the step axle 3*a*, so that a driving force can be reliably transmitted from the sprocket wheels 6*d* and 6*e* to the step axle 3*a* and the step chains 4 and 5, and the steps 3 can be smoothly turned around through the use of the step axle 3*a*.

Figure 7:
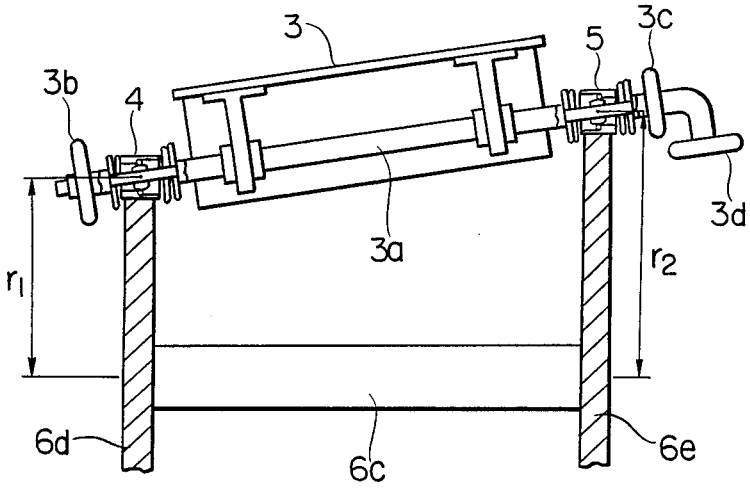

Within the inner and outer step chains 4 and 5, only the links 4*a* and 5*a* which the step axle 3*a* engages are allowed to deflect in three perpendicular directions as shown in FIG. 7. However, the next links 4*b* and 5*b* and the cylindrical connecting rollers 4*f* and 5*f* of the links 4*b* and 5*b* are not permitted to incline, similarly to the ordinary step chains. Also, as to the inner and outer sprocket wheels 6*d* and 6*e*, only the teeth 6*f* and 6*g* which engage the step axle 3*a* are provided with the inclined bottom surface and other teeth 6*h* and 6*i* are not inclined, similarly to the ordinary sprocket wheel. Since the teeth 6*f*, 6*h*, 6*g* and 6*i* are on a common pitch circle, the step chains 4 and 5 are driven around the sprocket wheels 6*d* and 6*e* on the same pitch circle and the same pitch, the step chains 4 and 5 are prevented from moving in a pulsating fashion, ensuring a comfortable ride on the moving steps 3. It is to be noted that although the description has been made in terms of the upper turn-around portion 2*d* of the stairway path 2, the present invention is similarly applicable to the lower turn-around portion 2*d* of the stairway.

FIGS. 8 to 11 illustrate another embodiment of a drive and guide roller assembly of the present invention. In the figures, a roller mount 14 is mounted at an outer end of the step axle 15 by a radial bearing 16 and a thrust bearing 17. The roller mount 14 is rotatable about the axis of the step axle 15 but is not movable in the direction of the axis of the step axle 15. Also, the roller mount 14 is disposed outside of the three-dimensionally deflectable outer step chain 5 coupled to the step axle 15. The roller mount 14 has mounted thereon a guide roller 18 rotatably mounted on a shaft 19 secured to the mount 14. The roller mount 14 has also mounted thereon a pair of outer drive rollers 20 rotatably mounted on a shaft 21 secured to the mount 14 on the front and rear sides of the guide roller 18.

On the inner end of the step axle 15 which extends outward beyond the three-dimensionally deflectable inner step chain 4 is mounted an inner drive roller 22 rotatable about the the axis of the axle 15. The step 3 is provided with trailing rollers 23 on the sides of the step 3. The trailing rollers 23 are rotatable about the axis parallel to the step axle 15 and are positioned on the inner side of the drive rollers 20 and 22. The inner and outer drive rollers 20 and 22 and the trailing rollers 23 are supported and guided by guide rails 10, 11, 12 and 13, respectively which are parallel to the stairway path 2, and the guide roller 18 is supported and guided by a guide rail 12 integral with the guide rail 11 and having a guide surface perpendicular to that of the guide rail 11 for the outer drive rollers 20.

Figure 8:
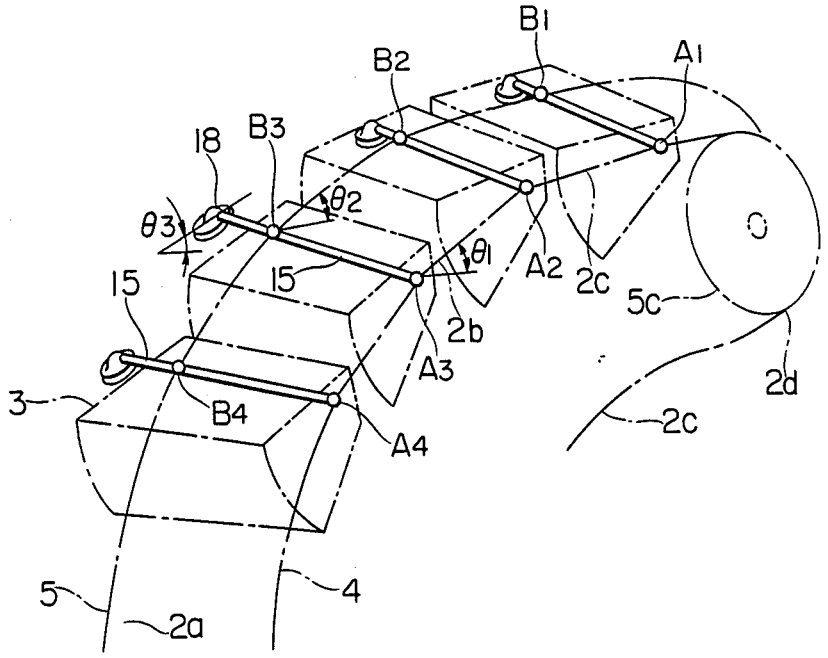
FIG. 8 is a schematic diagram illustrating the upper turn-around portion of the curved escalator of another embodiment of the present invention.
Figure 9:
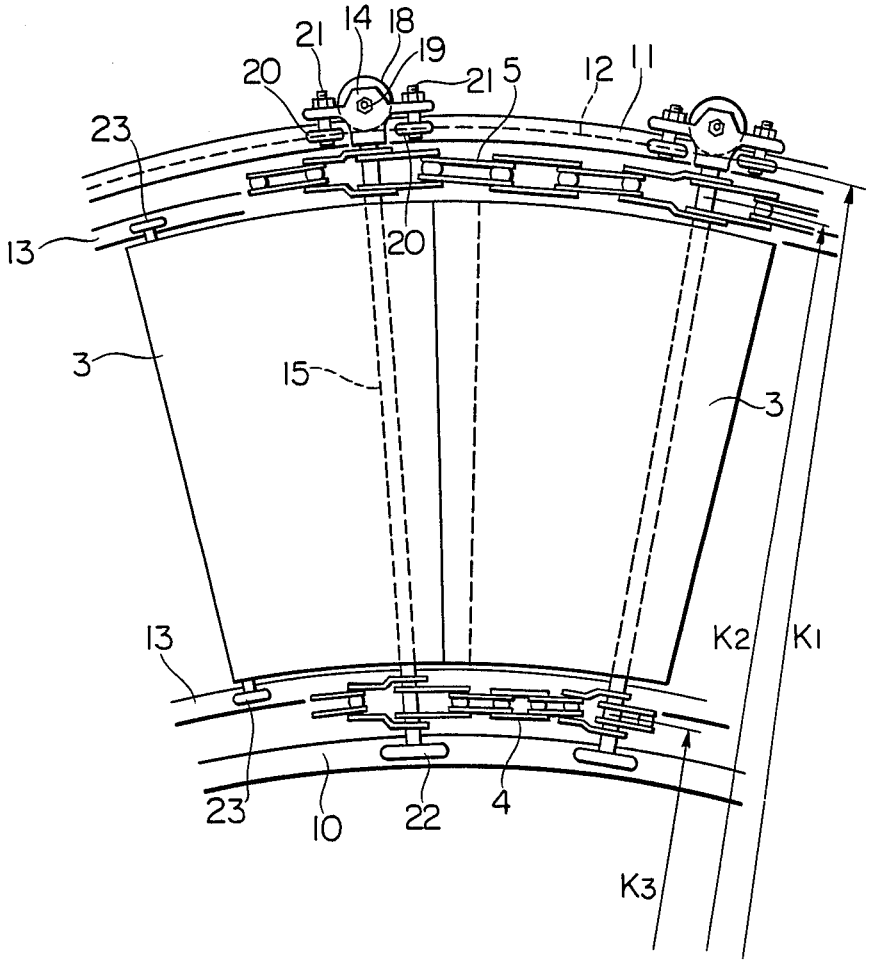
FIG. 9 is a partial plan view of the steps and the step chains of the second embodiment of the present invention.
Figure 10:
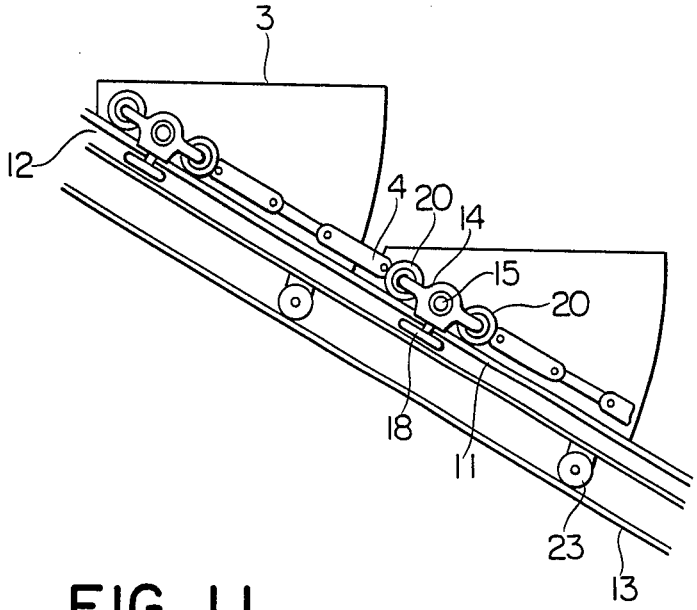
FIG. 10 is a side view of the steps and the outer step chain shown in FIG. 9.
Figure 11:
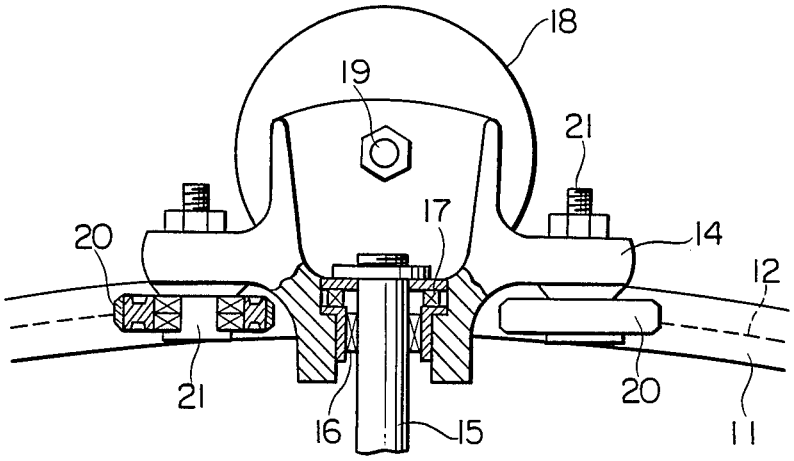
FIG. 11 is an enlarged plan view partially in section of the guide roller unit.

In a curved escalator, since it is necessary that the steps 3 circulate along the stairway path 2 as described above and that the tread of the steps 3 be maintained horizontal at least in the load bearing run, the step axles 15 must be kept in a horizontal position during their movement. Therefore, it is required that the three-dimensionally deflectable inner and outer step chains 4 and 5 connected to the step axles 15 of the steps 3 be deflectable in any direction with respect to the step axles 15, and that the guide rollers 18 which are subjected to a radial component of a force due to the movement of the step axles 15 along the curved stairway path and determine the direction of movement of the step axles 15 be able to be directed to any direction relative to the step axles 15. As shown in FIG. 8, in the intermediate sloped section 2a of the stairway path 2, the angles of inclination $\theta_1$, $\theta_2$ and $\theta_3$ of the inner and the outer step chains 4 and 5 and the guide roller 18 disposed at the outer end of the step axle 15, respectively, are expressed as follows:

$$K_1 \tan\theta_1 = K_2 \tan\theta_2 = K_3 \tan\theta_3$$

where, $K_1$, $K_2$ and $K_3$ are radii of curvature of the inner and the outer step chains and the guide roller, respectively as shown in FIG. 9, and $\theta_1$, $\theta_2$ and $\theta_3$ are angles of inclination of the inner and the outer step chains and the guide roller, respectively, as shown in FIG. 8.

As shown in FIG. 8, since the radii of curvature $K_1$, $K_2$ and $K_3$ are different from each other, the angles of inclination $\theta_1$, $\theta_2$ and $\theta_3$ are also different from each other. However, since the step axles 15 move only horizontally within the horizontal landing sections 2c, all of the angles of inclination $\theta_1$, $\theta_2$ and $\theta_3$ are equal to 0. Explaining this relationship with reference to FIG. 8, in the horizontal section 2c which is a plane defined by $A_1$, $A_2$, $B_1$ and $B_2$, the angles of inclination of the inner and the outer step chains as well as the guide roller are 0, while in the sloped section $A_2$, $A_3$, $B_3$ and $B_2$, the angles of inclination $\theta_1$, $\theta_2$ and $\theta_3$ are different from each other. Therefore, it is required that the connecting portion of the inner and the outer step chains 4 and 5 and the guide roller 18 to the step axles 15 be freely rotatable independently of the step axles 15.

According to this embodiment of the present invention, the mount 14 is mounted so as to be rotatable about the axis of the step axle 15 at the outer end of the step axle 15, and the guide roller 18 is mounted so as to be rotatable about the shaft 19 that is perpendicular to the the step axle 15. The pair of outer drive rollers 20 is mounted on the mount 14 on the shaft 21 perpendicular to the shaft 19 of the guide roller 18, whereby the position of the mount 14 is regulated by two drive rollers 20 to restrict the angle of inclination of the guide roller 18. Therefore, by providing a predetermined angle of inclination in the guide rail 11 for the outer drive roller 20, the guide roller 18 may be directed in any direction with respect to the step axle 15. Therefore, the guide roller 18 is subjected to a radial component of tension in the step chain 4, satisfying the previously explained requirements for the step axles 15 of the curved escalator, and maintaining the step axles 15 horizontally in the load-bearing run of the stairway path 2, allowing the tread of the steps 3 to be kept horizontal and the steps 3 to be stably and smoothly moved along the stairway path 2.

Further, according to this embodiment, since the arrangement is such that the rolling contact surface of the outer drive roller 20 and the guide rail 11 have the same radius of curvature when seen in plan as the rolling contact surface of the guide roller 18 and the guide rail 12, the angle of inclination of the guide rail 12 and the angle of inclination of the guide roller 18 can be made equal, thus minimizing the slippage of the guide roller 18 which reduces the wear of the guide roller 18.

Also, since the step axles 15 are rotatable relative to the step chains 4 and 5, and the rollers 18 and 20, a torsion peculiar to the curved escalator does not act upon the step axles 15, enabling the step axles 15 to be compact. Further, the roller mount, the guide roller, and the pair of drive rollers may be disposed at the inner end of the step axle.

What is claimed is:

1. A curved escalator having:

guide rails defining a stairway path, a plurality of segment-shaped steps movable along the stairway path, a step axle carrying each step, and an inner and an outer endless loop of step chains connected to the step axles and driven by sprocket wheels on sprocket shafts at upper and lower turn-around portions, the sprocket wheels having teeth formed by first recessed portions in which each step axle is received and second recessed portions between the first recessed portions, the step axles being inclined at an angle and turning around a conical surface at the upper and lower turn-around portions so that said steps circulate along the endless loops, each step chain including:

joint pieces and link members, each joint piece being engaged with an end part of one of said step axles, said link members having one end part connected with one end part of one of said joint pieces, said link members including rollers, means including a spherical roller and bearing providing a spherical joint connecting said end part of each joint piece to said one end part of each link member in a threedimensionally deflectable manner so as to allow said step axles to be disposed at an angle to said step chains in the turn-around portions, thus reducing the force exerted on said step chains, said spherical joint including a first roller having a spherical exterior surface and mounted on said one end part of said joint piece, a second roller having an interior surface matching the exterior surface of said first roller and mounted on said one end part of the connected link member, whereby said interior surface of said second roller and said exterior surface of said first roller form a sliding surface of said joint, bottom surfaces of the first recessed portions of the sprocket wheels being between respective teeth and sloped relative to the sprocket shafts so as to conform to the angle of the step axles in the turn-around portions and allow smooth transmission of driving force to the step axles, each of said step axles having:

a roller mount rotatably mounted on an end of said step axle, a guide roller rotatably mounted on said roller mount, said guide roller being rotatable about an axis perpendicular to and intersecting the longitudinal axis of said step axle and being engageable with one of said guide rails, and drive rollers mounted on both sides of said guide roller, said drive rollers each being rotatable about an axis parallel to said step axle and being engageable with one of said guide rails, whereby the position of said roller mount is regulated by said drive rollers to restict the angle of inclination of said guide roller and minimize slippage of said guide roller on the cooperating guide rail while allowing the steps to be kept horizontal while moved smoothly along the stairway path.

2. A curved escalator as claimed in claim 1 wherein the sprocket wheels comprise:

inner and outer sprocket wheels having different diameters driving said step axles along the conical surface in the turn-around portions of the inner and outer endless chain loops, bottom surfaces of the second recessed portions of the inner and outer sprocket wheels having no slope relative to the sprocket shaft so as to be parallel to the axis of said sprocket shaft in the turn-around portion, all teeth of each sprocket wheel being formed on a common pitch circle.

* * * * *